US011291274B2

(12) United States Patent
Seman

(10) Patent No.: US 11,291,274 B2
(45) Date of Patent: Apr. 5, 2022

(54) MAGNETIC BUCKLE WITH A DECOUPLING LIP

(71) Applicant: HONEYWELL INTERNATIONAL INC., Morris Plains, NJ (US)

(72) Inventor: Michael Seman, Morris Plains, NJ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

(21) Appl. No.: 16/769,351

(22) PCT Filed: Dec. 11, 2017

(86) PCT No.: PCT/US2017/065642
§ 371 (c)(1),
(2) Date: Jun. 3, 2020

(87) PCT Pub. No.: WO2019/117856
PCT Pub. Date: Jun. 20, 2019

(65) Prior Publication Data
US 2020/0305557 A1 Oct. 1, 2020

(51) Int. Cl.
*A44B 11/25* (2006.01)

(52) U.S. Cl.
CPC ..... *A44B 11/258* (2013.01); *A44D 2203/00* (2013.01)

(58) Field of Classification Search
CPC ..... A44D 2203/00; A45C 13/1069; A44B 11/258; A44B 11/2588; A44B 11/04
See application file for complete search history.

(56) References Cited

U.S. PATENT DOCUMENTS 2,807,852 A 10/1957 Jean
4,299,014 A 11/1981 Wood
(Continued)

FOREIGN PATENT DOCUMENTS

AU 554 843 B2 9/1986
DE 200 18 405 U1 1/2001
(Continued)

OTHER PUBLICATIONS

4Safe for Your Safety, "Mating Buckles," [online], retrieved from the Internet Sep. 21, 2020, <http://www.ppi-4safe.com/en/product/1#272>, 41 pages.
(Continued)

*Primary Examiner* — Robert Sandy
*Assistant Examiner* — Louis A Mercado
(74) *Attorney, Agent, or Firm* — Alston & Bird LLP

(57) ABSTRACT

Apparatus and associated methods relate to a pair of magnetic mating buckles including a first buckle (205) and second buckle (210), the first buckle extending beyond the second buckle's outer perimeter forming an extended lip. In an illustrative example, the lip may be manually manipulated to separate the first buckle from the second buckle when the pair of magnetic mating buckles are in a substantially planar magnetic engagement. In some examples, one or more magnets may be fixedly coupled to the first buckle, and/or the second buckle. In some examples, the buckles may be coupled to various webbings. In an engagement example, the first buckle may be inserted through a coupling aperture (215) in the second buckle. The coupling aperture may include one or more corner notches, for example. Various pairs of magnetic mating buckles with overhanging lips may advantageously provide leverage to manually separate the buckles without tools.

12 Claims, 6 Drawing Sheets

(56) References Cited

U.S. PATENT DOCUMENTS

| | | | | |
|---|---|---|---|---|
| 6,292,985 | B1 * | 9/2001 | Grunberger | A44B 11/2592 24/303 |
| 6,606,767 | B2 * | 8/2003 | Wong | A41F 1/006 24/303 |
| D721,010 | S * | 1/2015 | Spater | D11/218 |
| 9,307,808 | B1 | 4/2016 | Lill | |
| D907,527 | S * | 1/2021 | Spater | D11/218 |
| 2012/0044031 | A1 * | 2/2012 | Ninomiya | A44B 11/2596 335/219 |

FOREIGN PATENT DOCUMENTS

| | | | | |
|---|---|---|---|---|
| EP | 1408786 | B1 | 2/2008 | |
| GB | 960115 | A * | 6/1964 | A44B 11/2526 |
| GB | 2 527 327 | A | 12/2015 | |
| WO | 2016/175663 | A1 | 11/2016 | |

OTHER PUBLICATIONS

Adela Enterprise Co., Ltd, "CSA/ANSI Approved Hardware Accessories", [online], retreived from the Internet Sep. 21, 2020, <https://www.adela.com.tw/en/2-2993/manufacturer/CSA-ANSI-APPROVED-id125192.html>, 3 pages.

International Search Report of the International Searching Authority for PCT/US2017/065642 dated Aug. 9, 2018.

Outgoing Written Opinion of the ISA dated Aug. 9, 2018 for WO Application No. PCT/US17/065642, 8 pages.

* cited by examiner

MAGNETIC BUCKLE WITH A DECOUPLING LIP

TECHNICAL FIELD

Various embodiments relate generally to buckles.

BACKGROUND

Buckles may be a releasable and reusable form of coupling for various webbings. For example, buckles are ubiquitous in the fashion industry as a coupling mechanism for belts. Belt designers may design buckles that are not only functional, but fashionable as well. For example, a buckle may include decorative embossing or gemstones. Buckles may couple webbing that may include personal safety harnessing. Buckles may also fasten straps on various bags, packs, and luggage, for example.

SUMMARY

Apparatus and associated methods relate to a pair of magnetic mating buckles including a first buckle and second buckle, the first buckle extending beyond the second buckle's outer perimeter forming an extended lip. In an illustrative example, the lip may be manually manipulated to separate the first buckle from the second buckle when the pair of magnetic mating buckles are in a substantially planar magnetic engagement. In some examples, one or more magnets may be fixedly coupled to the first buckle, and/or the second buckle. In some examples, the buckles may be coupled to various webbings. In an engagement example, the first buckle may be inserted through a coupling aperture in the second buckle. The coupling aperture may include one or more corner notches, for example. Various pairs of magnetic mating buckles with overhanging lips may advantageously provide leverage to manually separate the buckles without tools.

Various embodiments may achieve one or more advantages. For example, some embodiments may keep the buckles registered together even during periods of slack webbing. Some examples may mitigate dangling buckles that may damage, snag, or short circuit nearby articles. The magnetic mating buckles may advantageously operate quietly due to mitigation of buckles banging together. The magnets may conveniently store articles coupled to the buckles, especially in the absence of wall hooks.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 2:
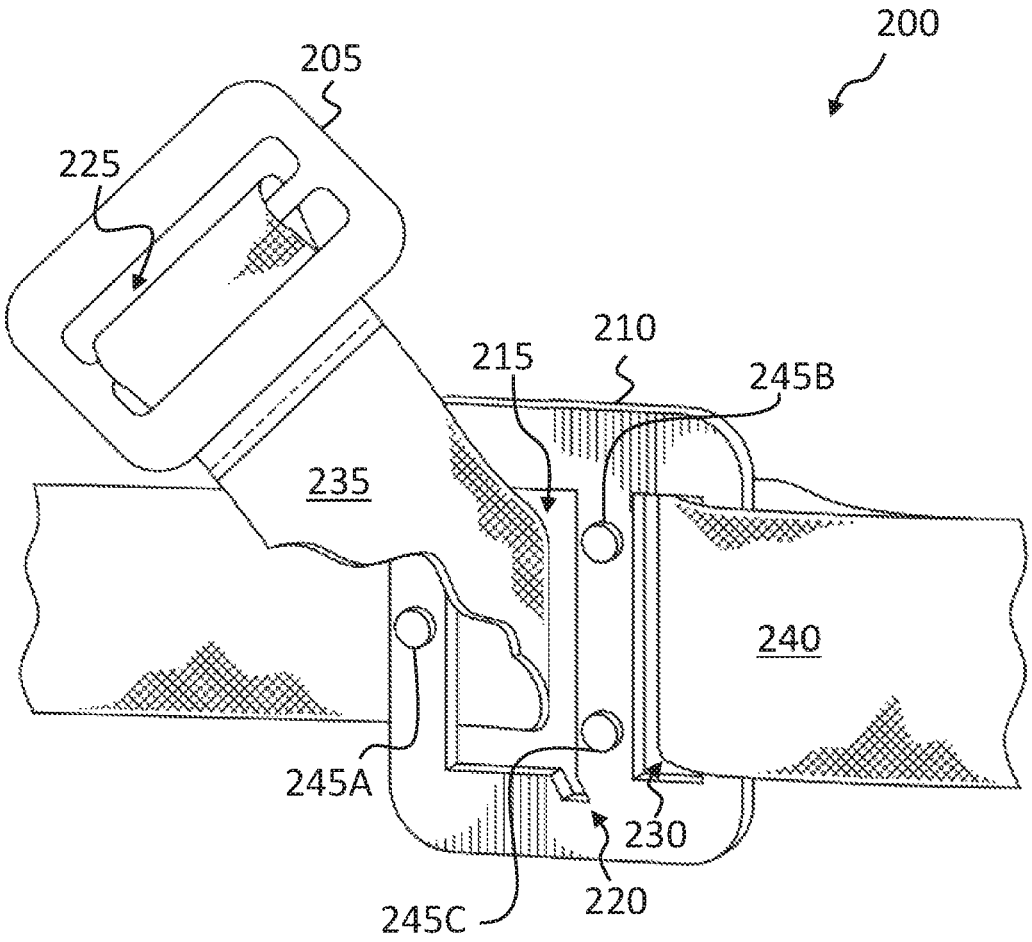
FIG. 2 depicts a perspective view of an exemplary magnetic buckle illustrating locations of one or more magnets.
Figure 3:
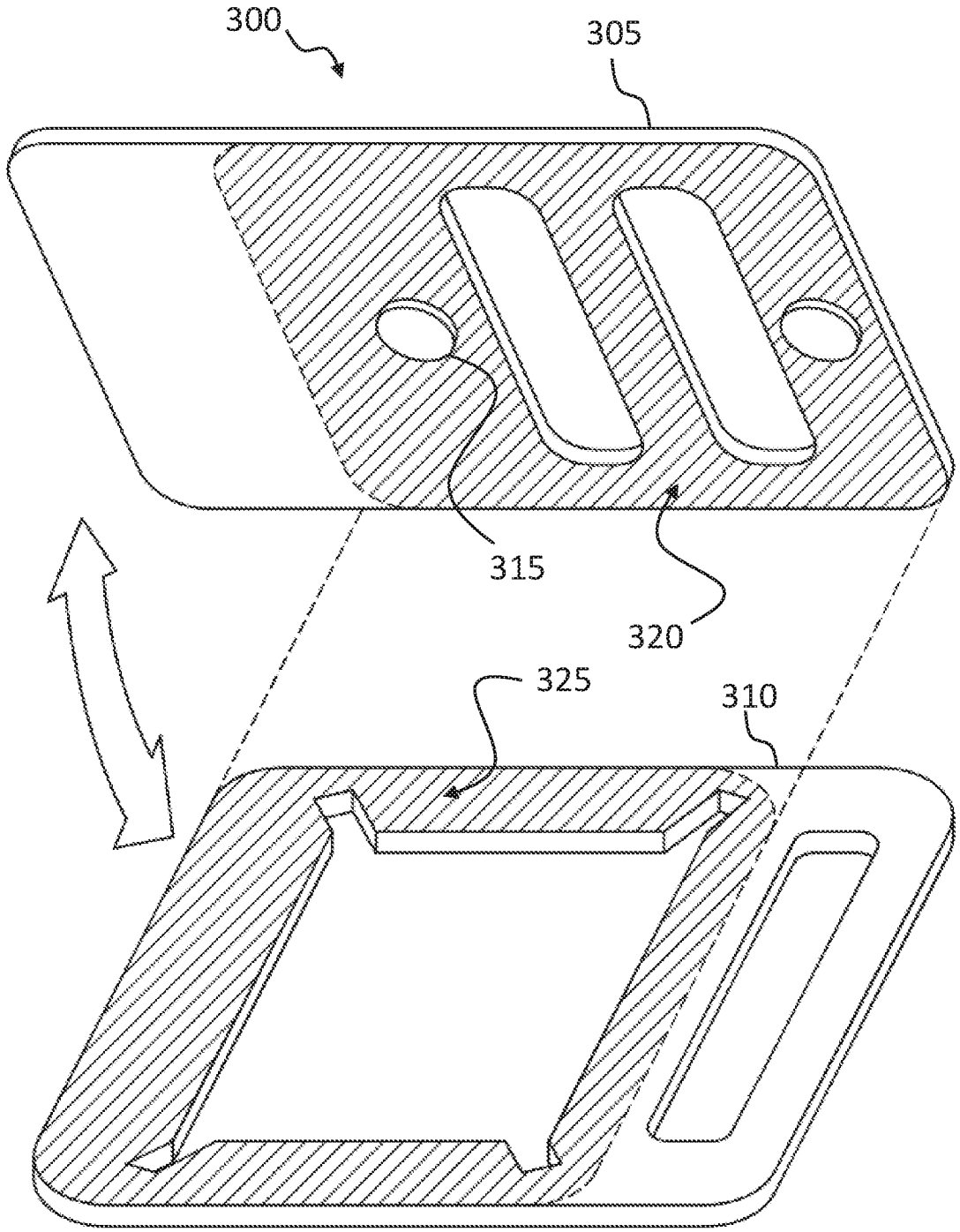
FIG. 3 depicts a perspective view of an exemplary magnetic buckle illustrating locations of magnets and mating surfaces.

To aid understanding, this document is organized as follows. First, an overhanging lip formed by a pair a of mating buckles is briefly introduced with reference to FIG. 1. Second, with reference to FIGS. 2 and 3, the discussion turns to exemplary embodiments that illustrate engagement methods of the pair of magnetic mating buckles. Specifically, FIG. 2 illustrates one buckle threaded through the other, and FIG. 3 illustrates the mating surface of each buckle. Finally, with reference to FIGS. 4-6, further illustrations of various overhanging lip embodiments are presented.

Figure 1:
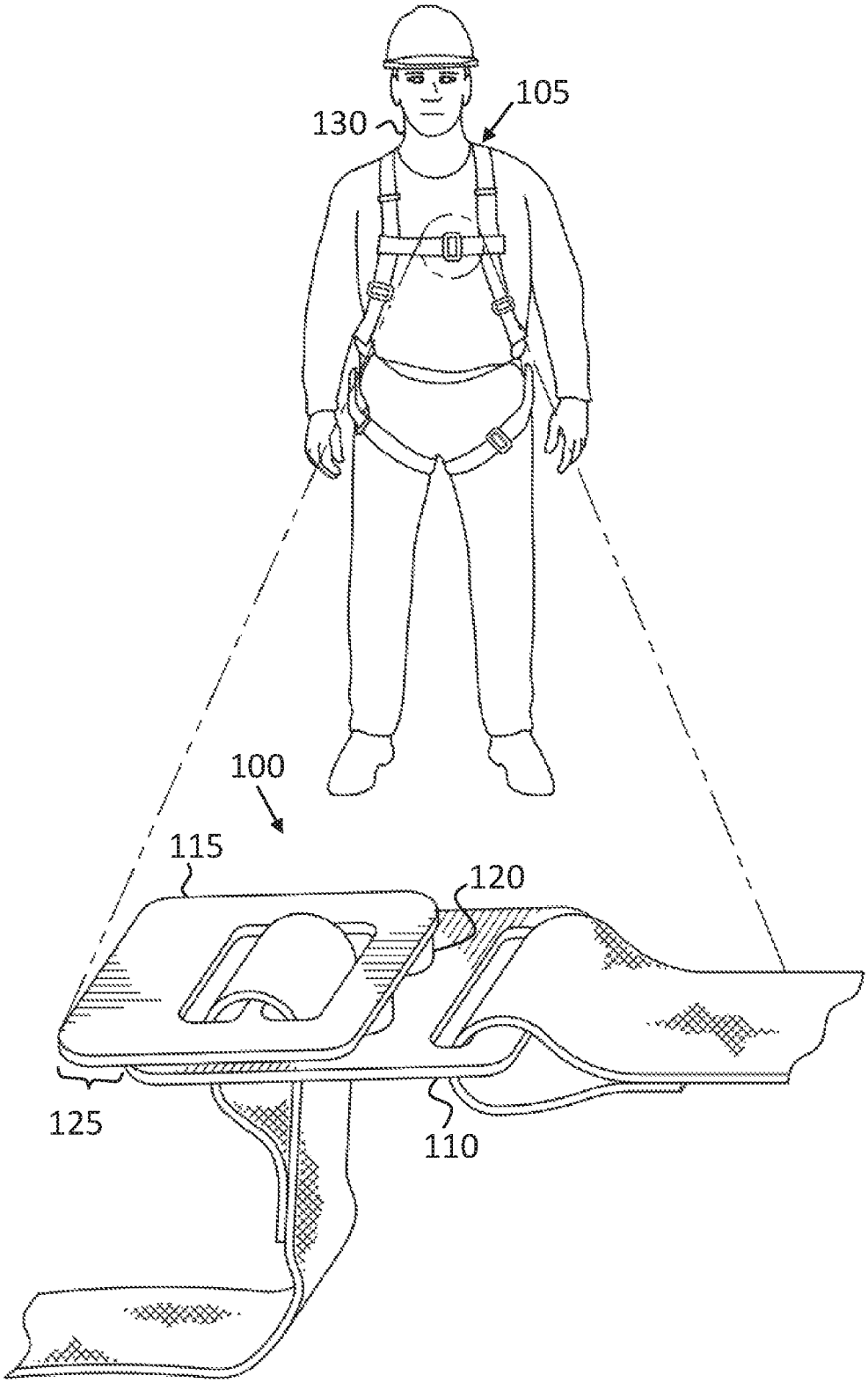
FIG. 1 depicts a perspective view of an exemplary top and bottom buckle in magnetic engagement on a worker's safety harness, the top buckle forming an overhanging lip with relationship to the bottom buckle.

FIG. 1 depicts a perspective view of an exemplary top and bottom buckle in magnetic engagement on a worker's safety harness, the top buckle forming an overhanging lip relative to the bottom buckle. In the depicted example, a buckle mechanism 100 is part of a worker's safety harness 105. The buckle mechanism 100 includes a bottom buckle 110. The bottom buckle 110 is magnetically coupled to a top buckle 115. A magnet 120 is fixedly coupled to the top buckle 115. The magnet 120 may be a magnetic field generator. In some examples, the top buckle 115 may include one or more magnets 120. In some examples, the magnets 120 may be fixedly coupled to the bottom buckle 110.

The buckle mechanism 100 is configured to form an overhanging lip 125 when the top buckle 115 is magnetically coupled with the bottom buckle 110. The overhanging lip 125 may aid a user in toollessly decoupling of the top buckle 115 from the bottom buckle 110. A user such as a worker 130 may manipulate the top buckle 115 and the bottom buckle 110 using the lip 125. For example, the worker 130 may grab ahold of the lip 125 and may pull apart the top buckle 115 from the bottom buckle 110. In various implementations, as in the depicted example, the buckle mechanism may be located in various locations on a worker's safety harness 105.

FIG. 2 depicts a perspective view of an exemplary magnetic buckle illustrating locations of one or more magnets. A magnetic buckle 200 includes a first buckle 205. The first buckle 205 is received by a second buckle 210. The first buckle 205 is received by the second buckle 210 via a second buckle aperture 215.

A longitudinal length of the first buckle 205 may be greater than a longitudinal length of the second buckle aperture 215. Accordingly, the second buckle aperture 215 may include a diagonal cut-out slot 220 in one or more opposing corners to facilitate threading the first buckle 205 through the second buckle aperture 215. The longitudinal length of the first buckle 205 being greater than the longitudinal length of the second buckle aperture 215 may advantageously mitigate unintentional decoupling of the first buckle 205 from the second buckle 210.

The first buckle 205 includes a longitudinal aperture 225. The first buckle 205 may include two or more longitudinal apertures 225. The second buckle 210 includes a longitudinal aperture 230. The second buckle 210 may include two or more of longitudinal apertures 230. The first buckle 205 is coupled to a first webbing 235. The second buckle 210 is coupled to a second webbing 240. A set of magnetic components 245A, 245B and 245C couple the first buckle 205 to the second buckle 210. When the buckles 205 and 210 are coupled (e.g., mated), the first buckle 205 may extend the past the mated surfaces and may form a lip. The lip may, for example, facilitate a user in toollessly decoupling the buckles 205 and 210.

FIG. 3 depicts a perspective view of an exemplary magnetic buckle illustrating locations of magnets and mating surfaces. A buckle set 300 includes a top buckle 305 and a bottom buckle 310. The top buckle includes a magnetic field generator 315. In some examples, one or more magnetic field generators 315 may be included on the top buckle 305 and/or the bottom buckle 310.

The top buckle 305 is configured to magnetically couple to the bottom buckle 310. When coupled, the buckles 305 and 310 define a top buckle registration region 320 and a bottom buckle registration region 325. The registration regions 320 and 325 are the overlapping and facing surfaces of the buckles 305 and 310. Further, the magnetic field generator 315 may establish a magnetic flux path extending between the top buckle registration region 320 and the bottom buckle registration region 325.

Figure 4:
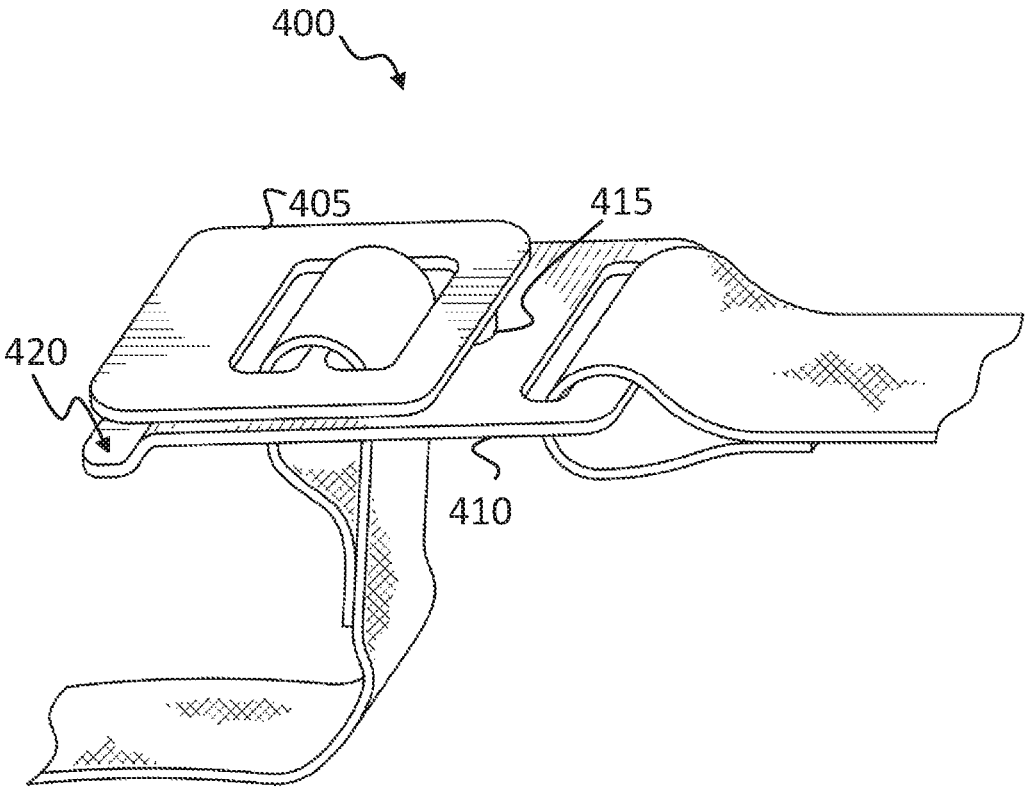
FIG. 4 depicts a perspective view of an exemplary magnetic buckle illustrating a parallel plane step for manual decoupling.

FIG. 4 depicts a perspective view of an exemplary magnetic buckle illustrating a parallel plane step for manual decoupling. A buckle system 400 includes a top buckle 405 and a bottom buckle 410. The top buckle 405 is magnetically coupled to the bottom buckle 410 by a magnet 415. The buckle system 400 may include one or more magnets 415 placed within a region between the top buckle 405 and the bottom buckle 410. The bottom buckle 410 includes a parallel plane step 420. The parallel plane step 420 may allow a user to place their fingers between the top buckle 405 and the bottom buckle 410. Further, the parallel plane step 420 may facilitate users in toollessly decoupling the top buckle 405 from the bottom buckle 410.

The parallel plane step 420 may be a lip. The parallel plane step 420 may include at least a portion of the side of the bottom buckle 410. Further, a parallel plane step (e.g., 420) may be included on the top buckle 405. In some examples, the parallel plane step 420 may be a depression.

Figure 5:
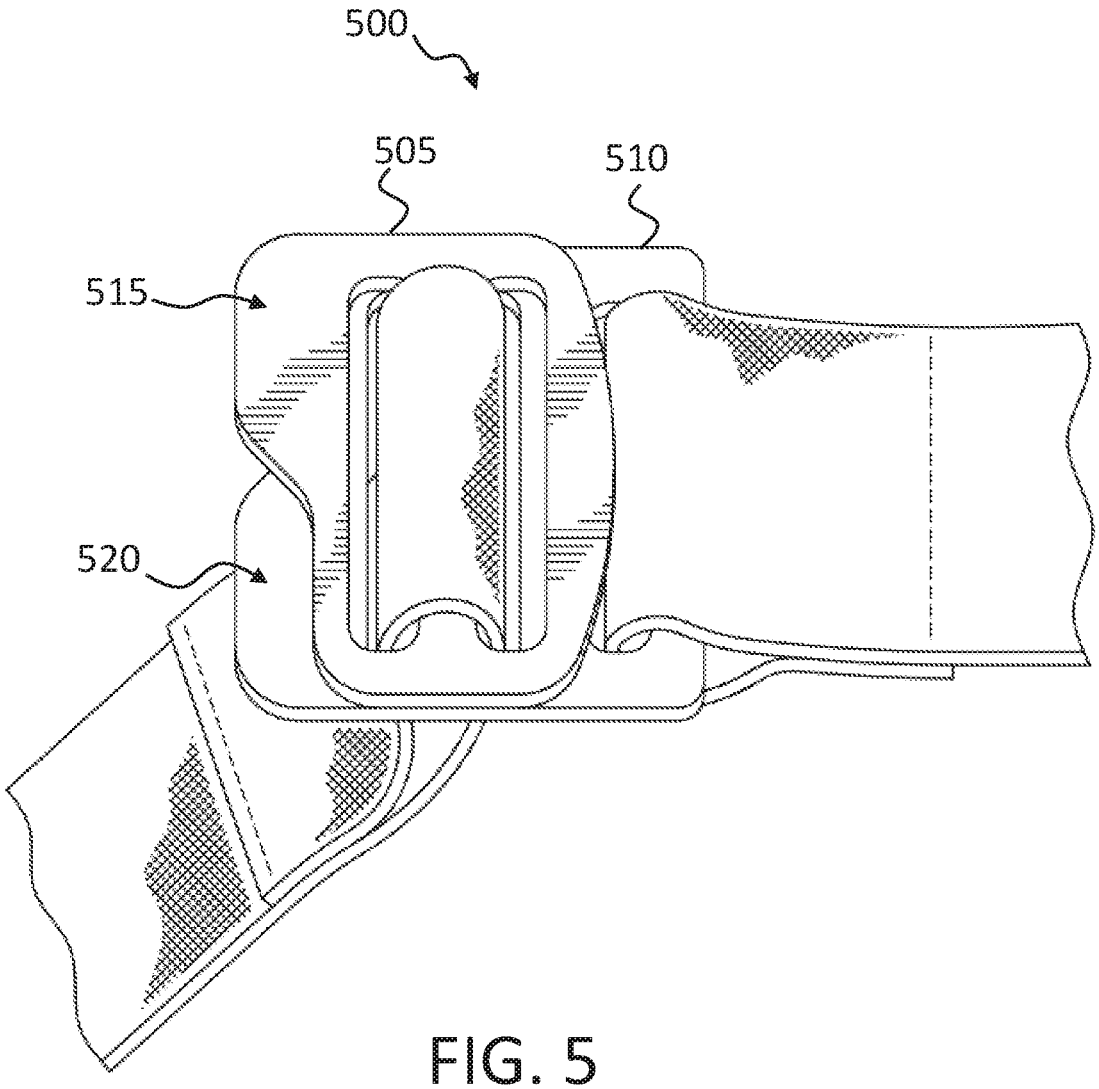
FIG. 5 depicts a perspective view of an exemplary magnetic buckle illustrating complementary tabs for manual decoupling.

FIG. 5 depicts a perspective view of an exemplary magnetic buckle illustrating complementary tabs for manual decoupling. A magnetic buckle system 500 includes a top buckle 505 and a bottom buckle 510. The top buckle 505 includes an extended surface across part of its distal edge forming an upper tab 515. The bottom buckle 510 includes an extended surface across part of its distal edge forming a lower tab 520. A user may decouple the top buckle 505 from the bottom buckle 510 by employment of the upper tab 515 and the lower tab 520. To decouple the buckles 505 and 510, the user may, for example, lay their right index finger on top of the lower tab 520 to form an anchor point, then place their right thumb under the upper tab 515. With an upward force, the user may lift off the top buckle 505 with their thumb. In some examples, the tabs 515, and 520 may be lips.

Figure 6:
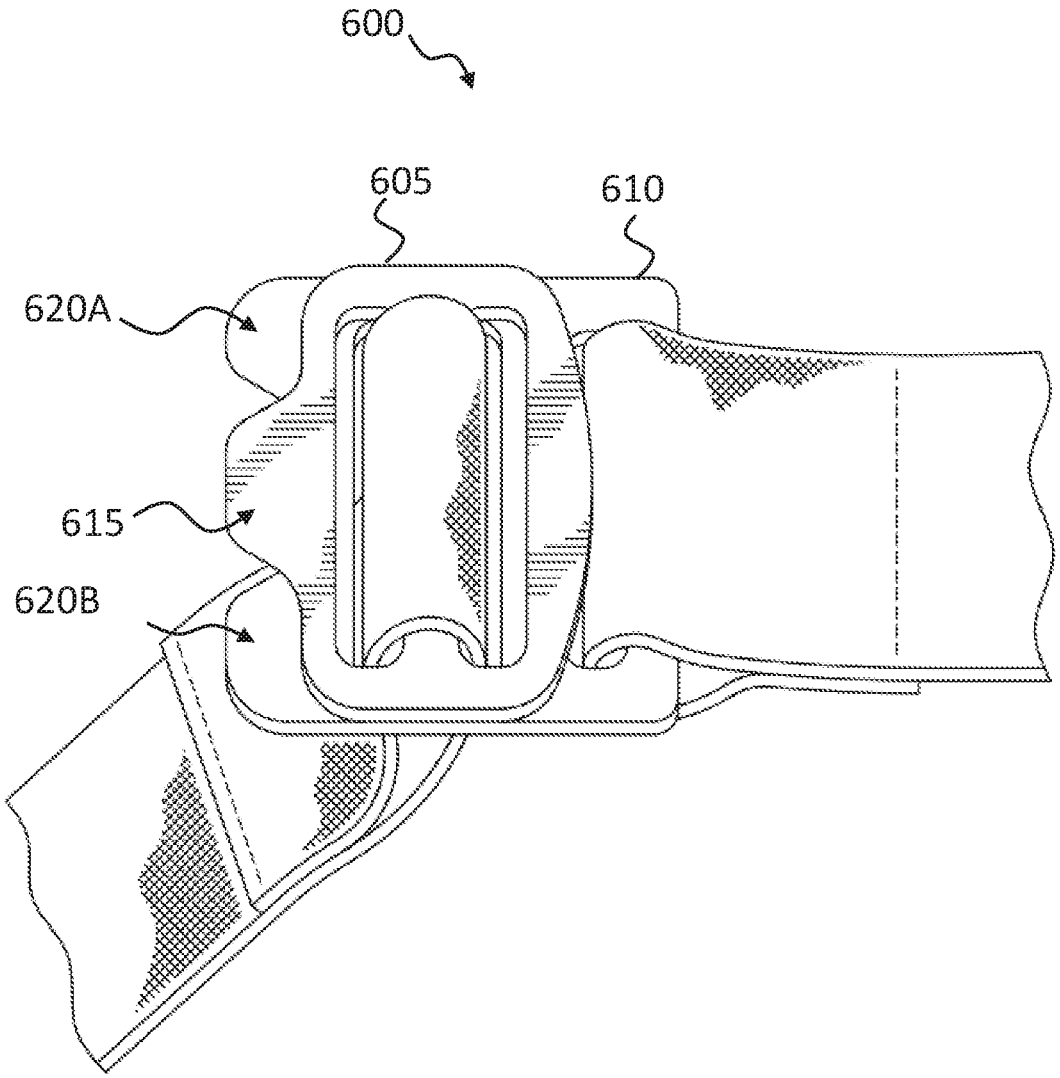
FIG. 6 depicts a perspective view of an exemplary magnetic buckle illustrating nested tabs for manual decoupling.

FIG. 6 depicts a perspective view of an exemplary magnetic buckle illustrating nested tabs for manual decoupling. A magnetic buckle system 600 includes a top buckle 605 and a bottom buckle 610. The top buckle 605 includes an extended surface across part of its distal edge forming an upper tab 615. The bottom buckle 610 includes an extended surface across two parts of its distal edge forming a left lower tab 620A and a right lower tab 620B. A user may decouple the top buckle 605 from the bottom buckle 610 by employment of the upper tab 615 and the lower tabs 620A and/or 620B. To decouple the buckles 605 and 610, the user may, for example, lay their left index finger on top of the left lower tab 620A and their right index finger on top of the right lower tab 620B to form two anchor points, then place their thumbs under the upper tab 615. With an upward force, the user may lift off the top buckle 605 with their thumbs. In some examples, the tabs 615, 620A and 620B may be lips.

Although various embodiments have been described with reference to the figures, other embodiments are possible. For example, some embodiments may include an electromagnet that may be remotely controlled. In an illustrative example, riders on an amusement ride, for example, bumper-cars, may be held in place by a magnetic buckle system until a remotely located ride operator releases the riders. Various embodiments may integrate a mechanical lever to aid the user in toollessly decoupling a first buckle from a second buckle.

In various examples, a pair of magnetic mating buckles may include a high magnetically permeable metal. The high magnetically permeable metal in the pair of magnetic mating buckles may be included in at least the sections that pull together with the magnets. Further, in some examples, one of the buckles may be steel, for example, and the other may be plastic with fixedly coupled magnets.

In an exemplary aspect, a magnetic buckle may include a substantially planar first buckle. The first buckle may include a first webbing aperture and a second webbing aperture. The first and second webbing apertures may extend along a longitudinal axis of the first buckle. The first and second webbing apertures may be substantially parallel to one another. Further, the first and second webbing apertures may be adapted to receive a first webbing. The first buckle may include a first buckle registration region, and an overhang portion.

The magnetic buckle may include a substantially planar second buckle. The second buckle may include a third webbing aperture, and a fourth webbing aperture. The third and fourth webbing apertures may extend along a longitudinal axis of the second buckle. The third and fourth webbing apertures may be substantially parallel to one another. The third webbing aperture may be adapted to receive the first webbing. The fourth webbing aperture may be adapted to receive a second webbing. The second buckle may include a second buckle registration region.

In some examples, a magnetic buckle may include a magnetic field generator adapted to establish a magnetic flux path extending between the first buckle registration region and the second buckle registration region. In some examples, when the first and second buckles are in a coupled relationship, the first buckle and second buckle may be held together via a magnetic coupling force associated with the magnetic field generator. Further, when the first and second buckles are in the coupled relationship, the first and second buckle registration regions may be adapted to register to each other, such that the overhang portion may extend beyond an envelope defined by an outer perimeter of the second buckle.

The third webbing aperture may include a first recess on one longitudinal and lateral edge of the third webbing aperture, and a second recess on the opposite longitudinal and lateral edge of the third webbing aperture. An axis extending between the first recess and the second recess may be at an acute angle relative to the longitudinal axis of the second buckle.

The magnetic field generator may include at least one magnet coupled to the first buckle. The magnetic field generator may further include two magnets located on opposite lateral ends of the first buckle.

The overhang portion may extend about 1 mm, 2 mm, 3 mm, 4 mm, 5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, 26 mm, 27 mm, 28 mm, 29 mm, 30 mm, 31 mm, 32 mm, 33 mm, 34 mm, 35 mm, 36 mm, 37 mm, 38 mm, 39 mm, or about 40 mm from the envelope defined by the outer perimeter of the second buckle.

In various embodiments, a magnetic buckle system may include a depression in the outer perimeter (e.g., FIG. 4, item 420) of the first and/or the second buckle for increased leverage for toollessly decoupling the first and second buckles from one another when in the coupled relationship. In some examples, a magnetic buckle may include a step, in a parallel plane of the magnetic buckle, in the outer perimeter of the second buckle for increased leverage for toollessly decoupling the first and second buckles from one another when in the coupled relationship.

The magnetic field generator may include a first planar surface of the first buckle and may include a first magnetization, and a second planar surface of the first buckle opposite the first planar surface. The first planar surface may include a second magnetization opposite from the first magnetization.

In an illustrative example, when the first and second buckles are in the coupled relationship, the overhang portion may extend beyond a lateral edge of the second buckle. When the first and second buckles are in the coupled relationship, the overhang portion may extend beyond a longitudinal edge of the second buckle. When the first and second buckles are in the coupled relationship, the first and second webbing apertures may be substantially parallel with the third and fourth webbing apertures.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A magnetic buckle comprising:

a substantially planar first buckle comprising:

a first webbing aperture;

a second webbing aperture, wherein the first and second webbing apertures: (1) extend along a longitudinal axis of the first buckle, (2) are substantially parallel to one another, and (3) are adapted to receive a first webbing;

a first buckle registration region; and, an overhang portion;

a substantially planar second buckle comprising:

a third webbing aperture;

a fourth webbing aperture, wherein the third and fourth webbing apertures: (1) extend along a longitudinal axis of the second buckle, and (2) are substantially parallel to one another, wherein the third webbing aperture is adapted to receive the first webbing, and the fourth webbing aperture is adapted to receive a second webbing;

a depression in an outer perimeter of the second buckle for increased leverage for separating the first and the second buckles from one another when in a coupled relationship; and, a second buckle registration region; and, a magnetic field generator adapted to establish a magnetic flux path extending between the first buckle registration region and the second buckle registration region, wherein when the first and second buckles are in the coupled relationship, the first buckle and second buckle are held together via a magnetic attraction force associated with the magnetic field generator;

wherein when the first and second buckles are in the coupled relationship the first and second buckle registration regions are adapted to register to each other, such that the overhang portion extends beyond an envelope defined by the outer perimeter of the second buckle; and, wherein the third webbing aperture comprises a first cut-out slot on one longitudinal edge and lateral edge of the third webbing aperture, and a second cut-out slot on the opposite longitudinal edge and lateral edge of the third webbing aperture, such that an axis extending between the first cut-out slot and the second cut-out slot is at an acute angle relative to the longitudinal axis of the second buckle.

2. The magnetic buckle of claim 1, wherein the magnetic field generator comprises at least one magnet disposed on the first buckle.

3. The magnetic buckle of claim 2, wherein the magnetic field generator further comprises two magnets disposed on opposite lateral ends of the first buckle.

4. The magnetic buckle of claim 1, wherein the overhang portion extends between 1 and 20 millimeters from the envelope defined by the outer perimeter of the second buckle.

5. The magnetic buckle of claim 1, wherein the overhang portion extends between 20 and 40 millimeters from the envelope defined by the outer perimeter of the second buckle.

6. The magnetic buckle of claim 1, wherein the magnetic field generator comprises a first planar surface of the first buckle having a first magnetization, and a second planar surface of the first buckle opposite the first planar surface having a second magnetization opposite from the first magnetization.

7. The magnetic buckle of claim 1, wherein when the first and second buckles are in the coupled relationship, the overhang portion extends beyond a lateral edge of the second buckle.

8. The magnetic buckle of claim 1, wherein when the first and second buckles are in the coupled relationship, the first and second webbing apertures are substantially parallel with the third and fourth webbing apertures.

9. A magnetic buckle comprising:

a substantially planar first buckle comprising:

a first webbing aperture;

a second webbing aperture, wherein the first and second webbing apertures: (1) extend along a longitudinal axis of the first buckle, (2) are substantially parallel to one another, and (3) are adapted to receive a first webbing;

a first buckle registration region; and, an overhang portion;

a substantially planar second buckle comprising:

a third webbing aperture;

a fourth webbing aperture, wherein the third and fourth webbing apertures: (1) extend along a longitudinal axis of the second buckle, and (2) are substantially parallel to one another; wherein the third webbing aperture is adapted to receive the first webbing, and the fourth webbing aperture is adapted to receive a second webbing;

a depression in an outer perimeter of the second buckle for increased leverage for separating the first and second buckles from one another when in a coupled relationship; and, a second buckle registration region; and, a magnetic field generator adapted to establish a magnetic flux path extending between the first buckle registration region and the second buckle registration region, wherein when the first and second buckles are in the coupled relationship, the first buckle and the second buckle are held together via a magnetic attraction force associated with the magnetic field generator; and, wherein when the first and second buckles are in the coupled relationship, the first and second buckle registration regions are adapted to register to each other, such that the overhang portion extends beyond an envelope defined by the outer perimeter of the second buckle.

10. The magnetic buckle claim 9, wherein the magnetic field generator comprises at least one magnet disposed on the first buckle.

11. The magnetic buckle of claim 10, wherein the magnetic field generator further comprises two magnets disposed on opposite lateral ends of the first buckle.

12. The magnetic buckle of claim 9, wherein the overhang portion extends between 1 and 20 millimeters from the envelope defined by the outer perimeter of the second buckle.

* * * * *